US008028349B2

(12) United States Patent
Petzl et al.

(10) Patent No.: US 8,028,349 B2
(45) Date of Patent: Oct. 4, 2011

(54) PROTECTIVE HELMET FOR HAIR WORN IN A PONY TAIL

(75) Inventors: Paul Petzl, Barraux (FR); Raphaël Lanez, Crolles (FR); Emmanuel D'Adhemar, Domène (FR)

(73) Assignee: Zedel, Crolles (FR)

( * ) Notice: Subject to any disclaimer, the term of this patent is extended or adjusted under 35 U.S.C. 154(b) by 132 days.

(21) Appl. No.: 12/457,534

(22) Filed: Jun. 15, 2009

(65) Prior Publication Data

US 2009/0320187 A1 Dec. 31, 2009

(30) Foreign Application Priority Data

Jun. 26, 2008 (FR) ..... 08 03614

(51) Int. Cl.
*A42B 1/22* (2006.01)

(52) U.S. Cl. ..... 2/418; 2/410; 2/417

(58) Field of Classification Search ..... 2/410, 417, 2/209.7, 209.4, 418, 421, 420, 419
See application file for complete search history.

(56) References Cited

U.S. PATENT DOCUMENTS

| | | | | |
|---|---|---|---|---|
| 3,748,657 | A * | 7/1973 | Aileo | 2/6.4 |
| 4,051,555 | A | 10/1977 | Daly | |
| RE34,699 | E * | 8/1994 | Copeland et al. | 2/419 |
| 5,659,900 | A * | 8/1997 | Arney et al. | 2/417 |
| 5,666,670 | A * | 9/1997 | Ryan et al. | 2/425 |
| D389,958 | S * | 1/1998 | Kinkead | D29/102 |
| 5,887,289 | A * | 3/1999 | Theoret | 2/425 |
| 6,665,884 | B1 | 12/2003 | Demps et al. | |
| 2006/0156448 | A1 * | 7/2006 | Garneau et al. | 2/10 |

FOREIGN PATENT DOCUMENTS

DE 20 2005 002 444 U1 5/2005

* cited by examiner

*Primary Examiner* — Gary L Welch
*Assistant Examiner* — Andrew W Collins
(74) *Attorney, Agent, or Firm* — Oliff & Berridge, PLC

(57) ABSTRACT

A protective helmet is composed of an external crown made from plastic material, and a semi-rigid neckband adjustable by adjustment means. To ensure that the helmet is efficiently secured on the user's head regardless of his or her hair-style, the neckband is in the shape of an Omega composed of lateral securing zones and a curved central part for free passage of the user's hair worn in a pony tail. The ends of the lateral securing zones of the neckband are joined to the adjustment means.

4 Claims, 6 Drawing Sheets

PROTECTIVE HELMET FOR HAIR WORN IN A PONY TAIL

BACKGROUND OF THE INVENTION

The invention relates to a protective helmet composed of a crown made from plastic material and a semi-rigid neckband adjustable by adjustment means.

STATE OF THE ART

The ELIOS helmet marketed under the PETZL trademark by the applicant relates to a helmet having a crown made from shock-resistant injected polycarbonate, an internal shell made from expanded polypropylene foam, a chin strap, and a headband. Adjustment of the latter is performed by means of a single adjustment point located at the rear of the helmet at the level of the neck. The adjustment device comprises racks arranged at the two straight rear ends of the headband and operating in conjunction with a rotary operating part which is placed in the middle zone. Such a design of the headband with a straight rear part equipped with the adjustment system in the middle part thereof is suitable for most users, but is less practical for women and men wearing their hair in a pony tail.

The document U.S. Pat. No. 5,887,289 mentions a safety helmet for golfers comprising an internal shell made from rigid plastic material which is covered by a fabric cap of complementary shape, for example made from cotton permeable to air. The internal shell comprises ventilation holes at the top part and a semi-circular recess at the rear. The rear of the flexible cap is also provided with a semi-circular notch placed facing the recess of the shell. A strap equipped with an adjustment buckle enables the notch of the flexible fabric cap to be tightened more or less, but does not enable adjustment of the shell which is rigid. Such a cap is not pressed tightly against the user's head and is not suitable for mountain climbing.

OBJECT OF THE INVENTION

The object of the invention consists in providing a protective helmet equipped with an easily adjustable neckband enabling it to be secured efficiently on the user's head, regardless of his or her type of hair-style.

The device according to the invention is characterized in that the neckband presents an Omega-shaped outline composed of lateral zones for securing on the head and a curved central part for free passage of the user's hair in a pony tail, and that the ends of the lateral securing zones of the neckband are joined to the adjustment means.

The ends of the neckband are preferably joined to the crown by adjustment means which can comprise any type of adjustment, in particular a rotary or sliding mechanical linkage. Adjustment is thus made from the lateral sides of the helmet, without being hampered at the back by a pony tail should the user have one. The pony tail passes in the recess of the neckband without interfering with the firm securing of the helmet on the user's head.

According to a preferred embodiment, the sliding mechanical linkage is composed of a rack arranged in the inside wall of at least one side of the crown and of a slider that is able to be moved from the outside in a slit of the crown after an unlocking button has been released. The rack is moulded directly with the crown, and the unlocking button is equipped with a coupling part bearing pins cooperating with the rack by the action of a return spring.

The rack preferably comprises two series of notches separated by said slit, and the slider supports two guide legs for guiding the unlocking button when the latter is moved between the active and inactive positions.

BRIEF DESCRIPTION OF THE DRAWINGS

Other advantages and features will become more clearly apparent from the following description of particular embodiments of the invention given for non-restrictive example purposes only and represented in the appended drawings in which.

DESCRIPTION OF A PREFERRED EMBODIMENT OF THE INVENTION

Figure 1:
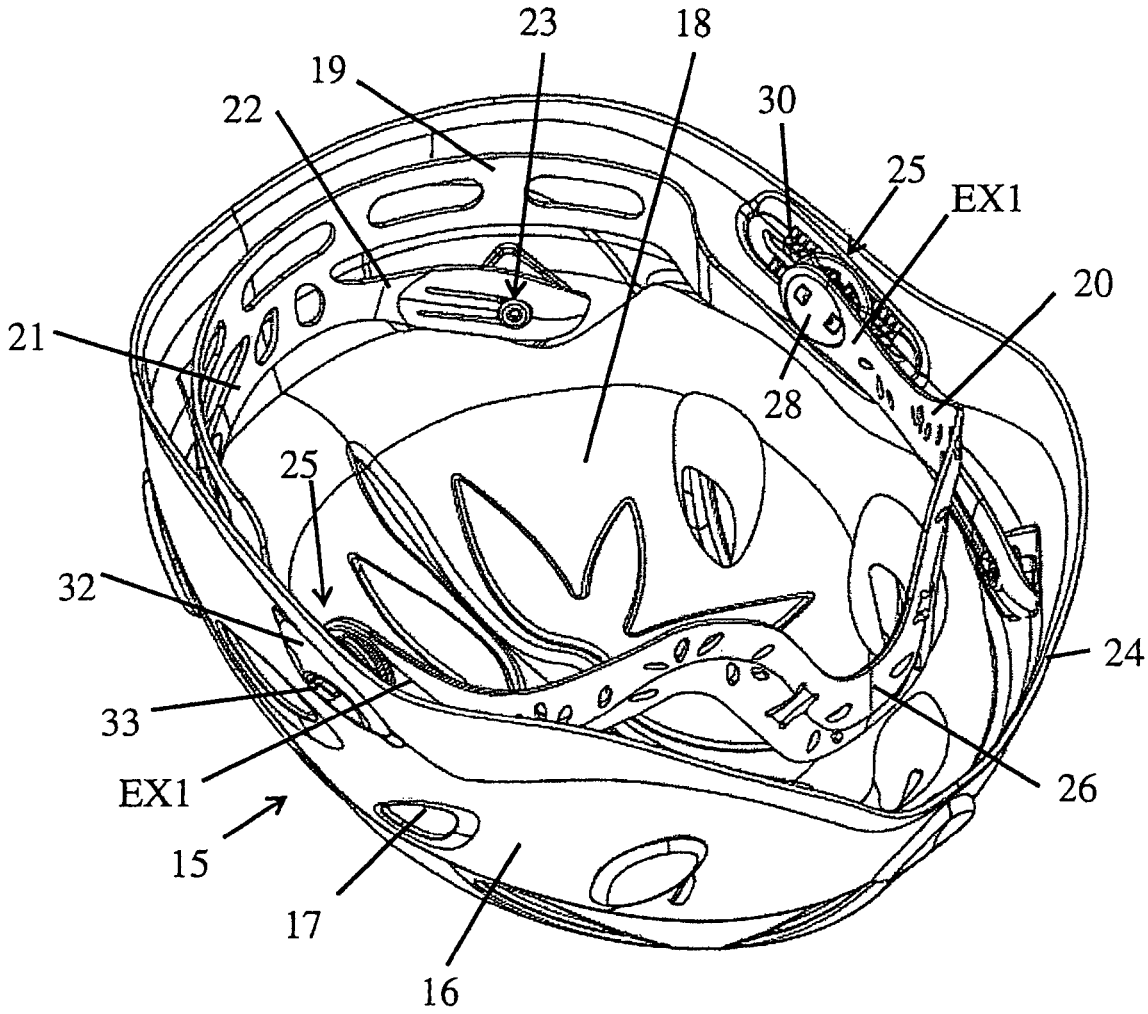
FIG. 1 represents a perspective view of the inside of the helmet with the neckband adjustment device according to the invention.
Figure 2:
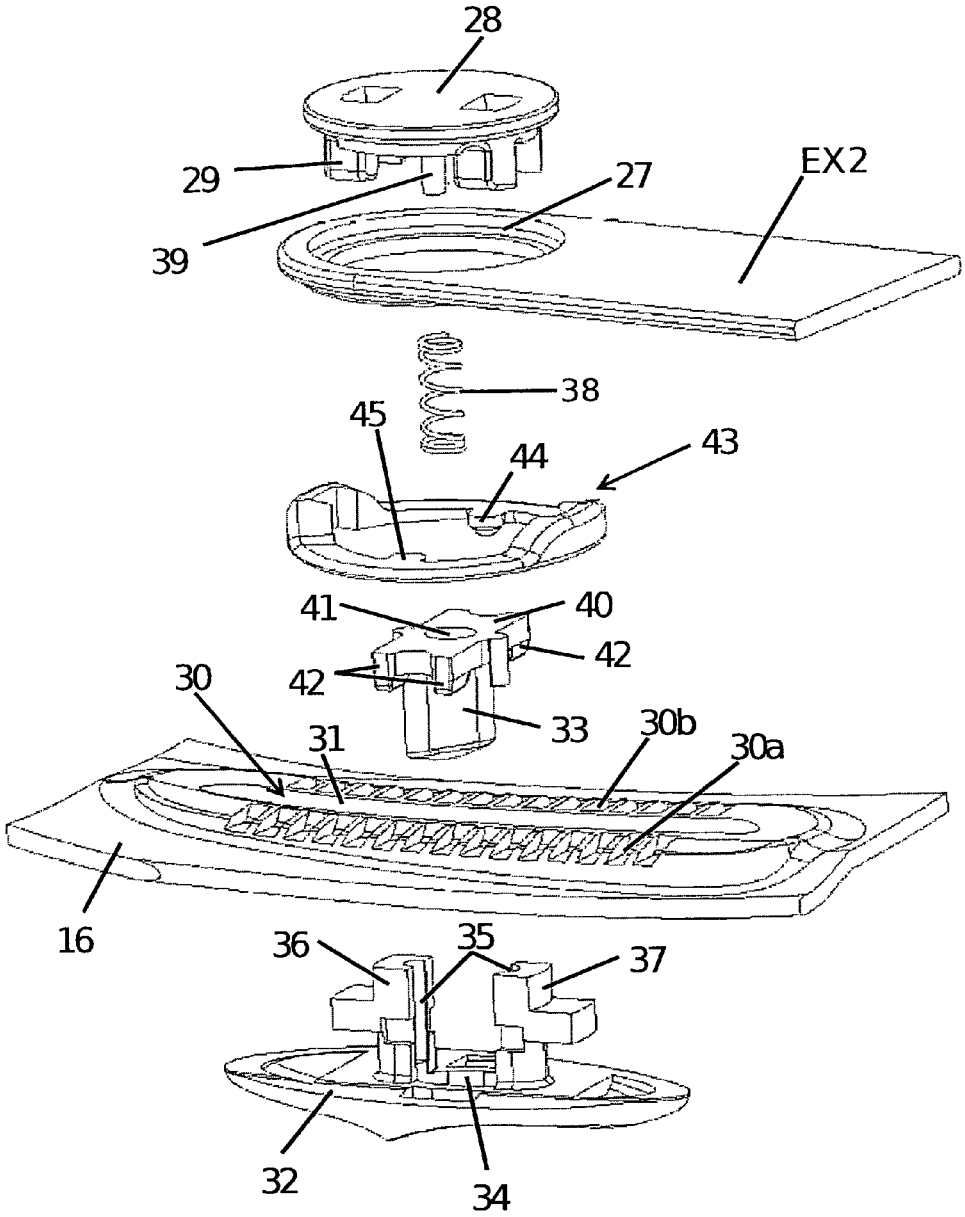
FIG. 2 is an exploded perspective view of the neckband adjustment device according to FIG. 1.
Figure 3:
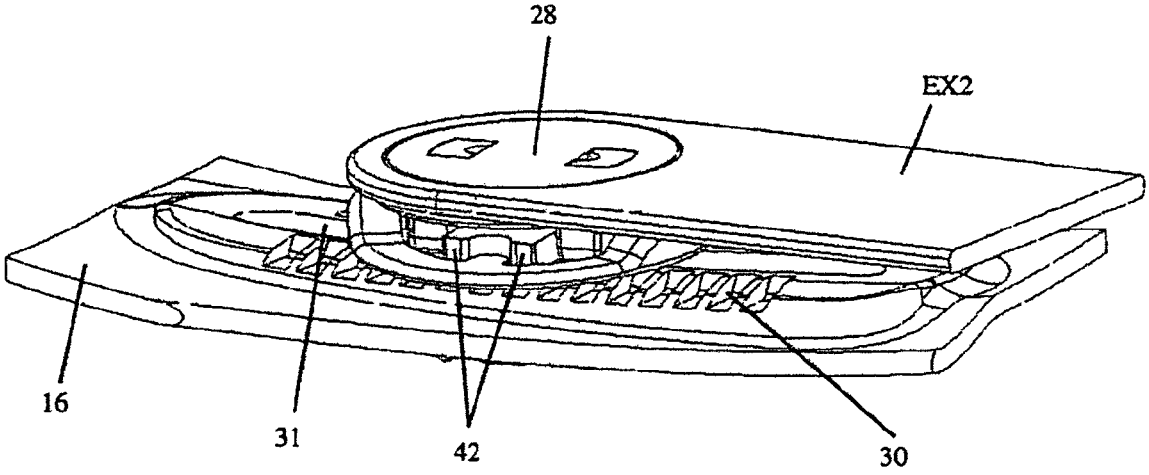
FIG. 3 shows the neckband adjustment device of FIG. 2 in the assembled position.
Figure 4:
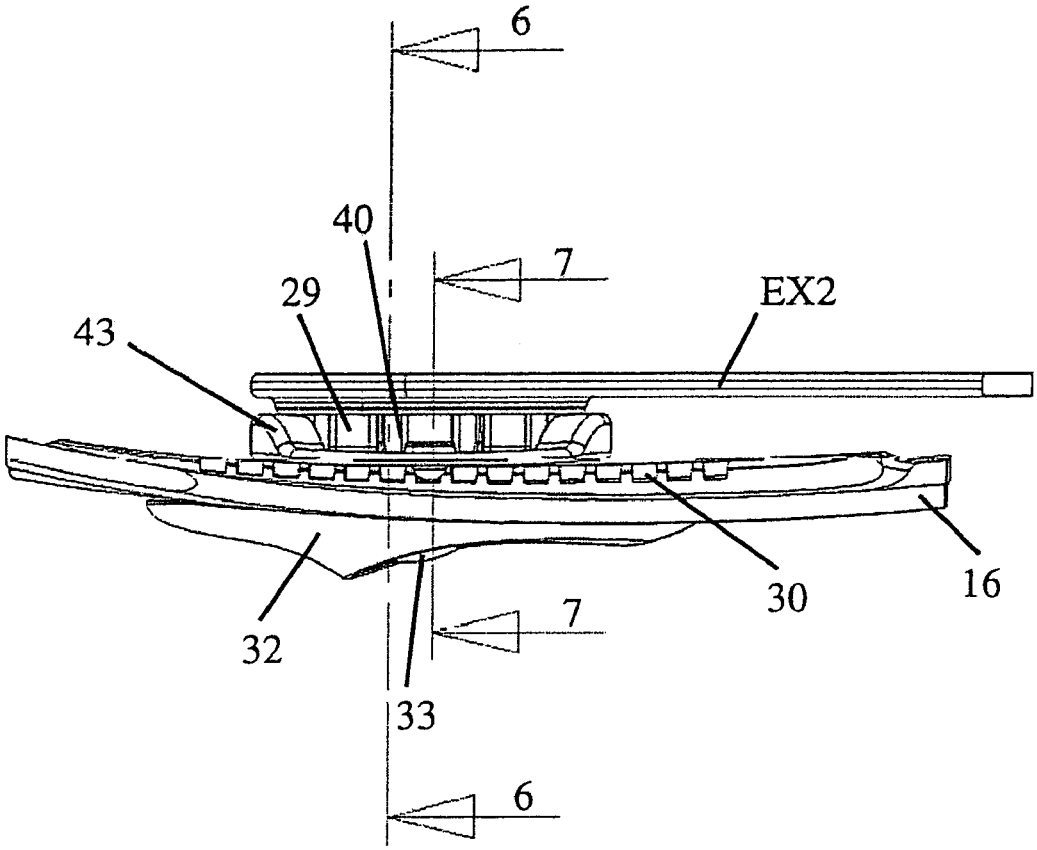
FIGS. 4 and 5 are cross-sectional views of the adjustment device of FIG. 3, respectively in the active position and in the inactive position of the unlocking button.
Figure 5:
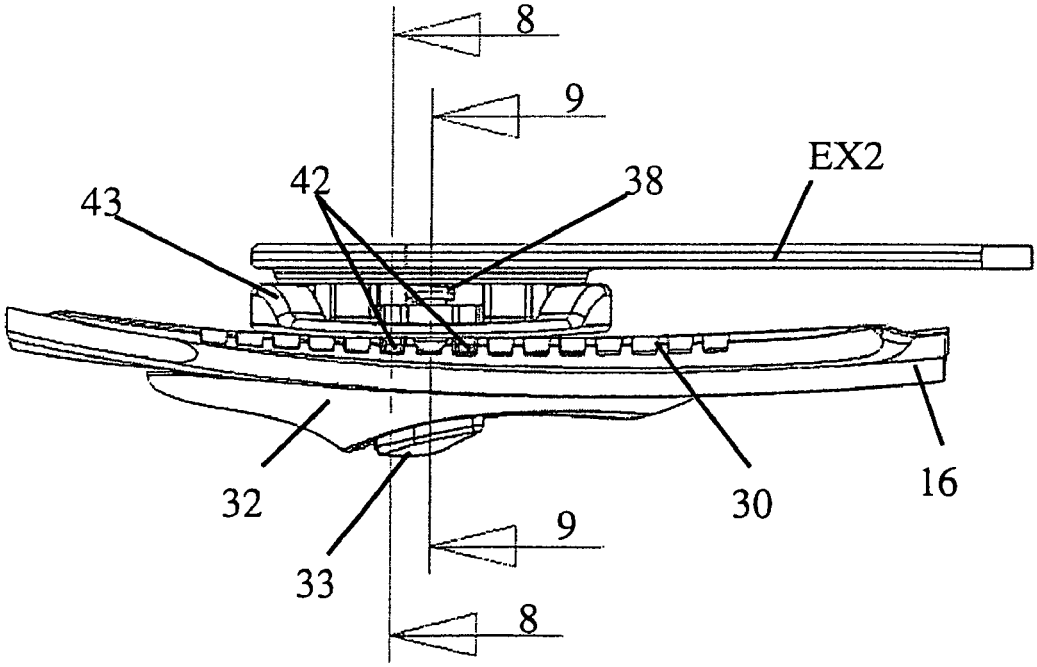
Figure 6:
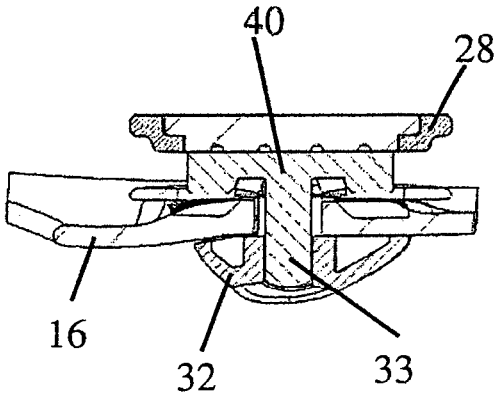
FIGS. 6 and 7 are cross-sectional views along the cross-sectional lines 6-6 and 7-7 of FIG. 4, when the unlocking button is in the active position enabling adjustment of the neckband in translation.
Figure 7:
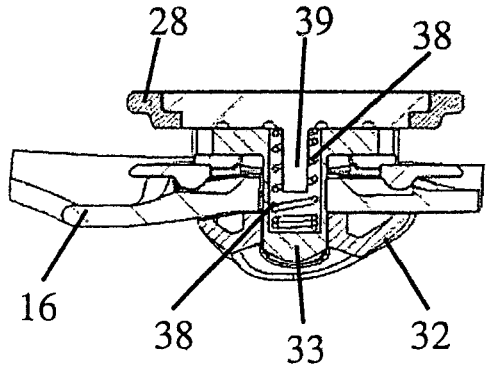
Figure 8:
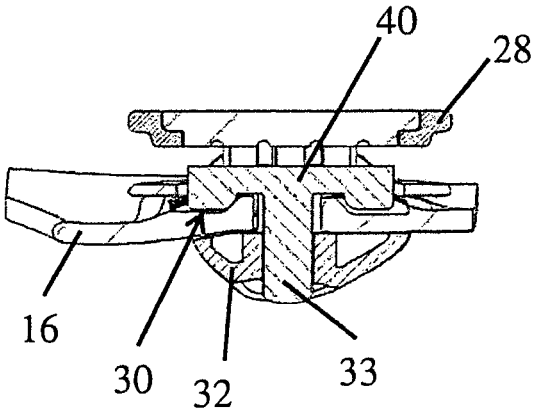
FIGS. 8 and 9 are cross-sectional views along the cross-sectional lines 8-8 and 9-9 of FIG. 5, when the unlocking button is in the inactive position corresponding to a predetermined adjustment of the neckband.
Figure 9:
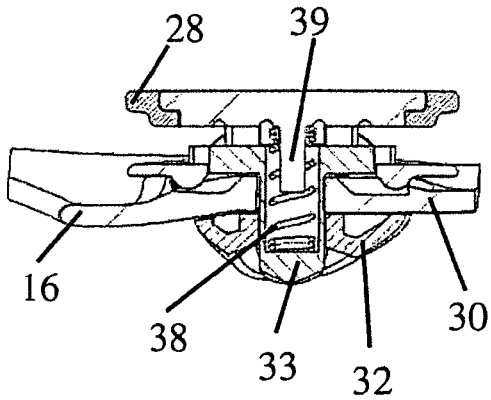
Figure 10:
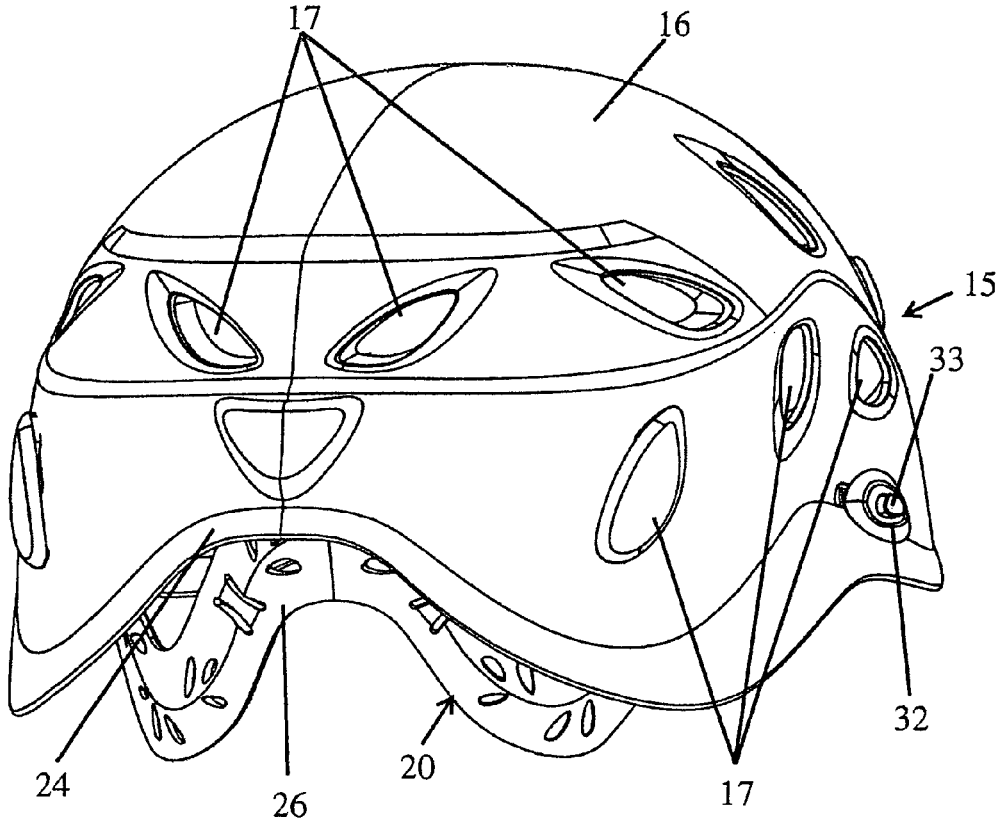
FIG. 10 is a perspective view from the rear of the helmet according to the invention.

In FIGS. 1 and 10, a helmet 15 comprises an external protection crown 16 made from injected polycarbonate or from any other molded plastic material. Crown 16 can also be thermoformed or be made from expanded polystyrene.

Crown 16 is equipped with a plurality of ventilation holes 17, a foam-padded shell 18 housed inside crown 16 with a headband 19, and a neckband 20. The neck strap is of well-known type and is not represented in the drawings. Such a helmet is in particular well suited for rock-climbing, mountaineering, and also for working at heights.

Headband 19 extends along the front rim of crown 16, being joined by two joining arms 21, 22 to attachment means 23 securedly attached to the inside wall of crown 16. The rear peripheral rim of crown 16 is located opposite the front rim and has a curved reverse U-shaped outline 24. In the example of FIG. 1, headband 19 is not adjustable.

Neckband 20 is adjustable by adjustment means 25 accessible from the outside on the opposite lateral sides of crown 16.

In FIGS. 2 to 9 and 11, neckband 20 is formed by an Omega-shaped strip of flexible or semi-rigid plastic having two opposite ends EX1, EX2 and a central part 26, which is offset from the outline 24 of crown 16 by a rear space. Each end EX1, EX2 of neckband 20 comprises a circular hole 27 in which there is engaged a securing prong 28 equipped with a plurality of pins 29 directed in the direction of a rack 30 arranged in the inside wall of crown 16.

Rack 30 comprises two series of parallel notches 30*a*, 30*b* separated from one another by a longitudinal slit 31 inside which a slider 32 moves after an unlocking button 33 has been actuated. Rack 30 is molded directly with crown 16, and unlocking button 33 passes through an opening 34 of slider 32 being guided in slide rails 35 arranged in the guide legs 36, 37 of slider 32.

A return spring 38 of the compression type is arranged between a centring pin 39 of securing prong 28 and a hole 41 arranged in a coupling part 40 securedly attached to unlocking button 33.

Coupling part 40 bears studs 42 cooperating with rack 30 by the action of return spring 38 biasing to the released position of unlocking button 33.

An indexing washer 43 (FIG. 2) is further fitted between rack 30 and corresponding end EX1, EX2 of neckband 20. Washer 43 comprises a pair of semi-circular protuberances 44, 45 located diametrically opposite along the internal periphery so as to engage, for a predetermined adjustment, between two successive notches of each series of notches 30*a*, 30*b* of rack 30. Any change of adjustment emits an audible click of protuberances 44, 45 following movement of slider 32 in translation.

Figure 11:
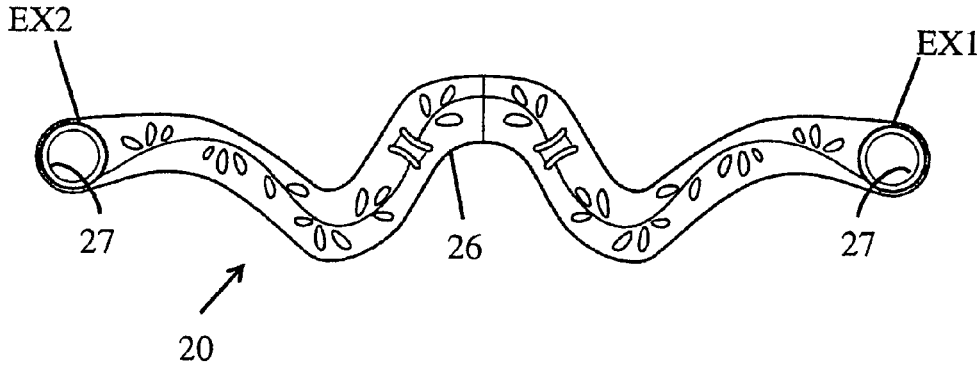
FIG. 11 represents a developed view of the neckband of FIGS. 1 and 10.

In FIG. 11, a developed view of neckband 20 of FIG. 10 shows the Omega shape with the curved central part 26 providing a passage or a recess under outline 24 of crown 16, which is particularly practical for users having their hair in a pony tail.

Adjustment of neckband 20 according to the invention is performed in the following manner:

The user presses at the same time with both hands on the two unlocking buttons 33 against the force of return springs 38. Studs 42 of coupling part 40 leave rack 30, which releases ends EX1, EX2 of neckband 20. Sliders 32 then simply have to be moved in translation in slits 31 until neckband 20 makes contact against the user's neck. Releasing unlocking buttons 33 automatically makes studs 42 move into the corresponding rack 30, thereby blocking the adjustment in the selected position.

Adjustment is quick and is performed from the outside on the lateral sides of crown 16, without being hampered at the back by the possible presence of a pony tail. The latter passes in the recess of Omega-shaped neckband 20, without interfering with the firm securing of the helmet on the user's head.

The sliding mechanical link by a rack securedly attached to the crown, as described in FIGS. 2-9, can be replaced by any other adjustment system.

The invention claimed is:

1. A protective helmet comprising:

a crown, said crown having an exterior surface and an interior surface, a semi-rigid neckband having:

two end portions extending substantially parallel to an edge of the crown from respective lateral sides of the crown towards a rear side of the crown; and an arcuate central portion at the rear side of the crown, extending into the crown and configured to run around a pony tail of the helmet wearer; and adjustment means joining the end portions of the neckband to the lateral sides of the crown, wherein the adjustment means comprise a sliding mechanical link, the sliding mechanical link is composed of a rack arranged in the inside wall of at least one side of the crown and a slider able to be moved from the outside in a slit of the crown after the unlocking button has been released, and the rack is molded directly into the interior surface of the crown without additional fasteners.

2. The protective helmet according to claim 1, wherein the unlocking button is equipped with a coupling part bearing studs cooperating with the rack by the action of a return spring in the released position of said button.

3. The protective helmet according to claim 2, wherein the return spring of compression type is arranged between a centering pin securely affixed to a securing prong associated with each end portion of the neckband, and a hole arranged in the coupling part.

4. The protective helmet according to claim 1, wherein the rack comprises two series of notches separated by said slit and the slider bears two guide legs for guiding the unlocking button when the latter is moved between the active and inactive positions.

* * * * *